US010220634B2

(12) United States Patent
Tsuji

(10) Patent No.: US 10,220,634 B2
(45) Date of Patent: Mar. 5, 2019

(54) INKJET RECORDING APPARATUS CAPABLE OF PREVENTING BACKFLOW OF INK

(71) Applicant: KYOCERA Document Solutions Inc., Osaka-shi, Osaka (JP)

(72) Inventor: Kikunosuke Tsuji, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/897,081

(22) Filed: Feb. 14, 2018

(65) Prior Publication Data

US 2018/0236775 A1 Aug. 23, 2018

(30) Foreign Application Priority Data

Feb. 22, 2017 (JP) ..... 2017-030782

(51) Int. Cl.

| | |
|---|---|
| ***B41J 2/175*** | (2006.01) |
| ***B41J 2/14*** | (2006.01) |
| ***B41J 2/16*** | (2006.01) |
| ***B41J 2/21*** | (2006.01) |

(52) U.S. Cl.

CPC ..... *B41J 2/17596* (2013.01); *B41J 2/16* (2013.01); *B41J 2/175* (2013.01); *B41J 2/17523* (2013.01); *B41J 2/17556* (2013.01); *B41J 2/17566* (2013.01); *B41J 2/21* (2013.01); *B41J 2/1404* (2013.01); *B41J 2202/05* (2013.01); *B41J 2202/12* (2013.01)

(58) Field of Classification Search

CPC . B41J 2/165; B41J 2/21; B41J 2202/05; B41J 2202/12; B41J 2/175; B41J 2/17523; B41J 2/17596; B41J 2/17556; B41J 2/17566; B41J 2/1404

See application file for complete search history.

(56) References Cited

U.S. PATENT DOCUMENTS 6,883,905 B2 * 4/2005 Kimura ..... B41J 2/175 347/85
7,467,858 B2 * 12/2008 Lebron ..... B41J 2/165 347/85

FOREIGN PATENT DOCUMENTS

JP 2009101668 A 5/2009

* cited by examiner

*Primary Examiner* — Thinh H Nguyen
(74) *Attorney, Agent, or Firm* — Alleman Hall Creasman & Tuttle LLP

(57) ABSTRACT

An inkjet recording apparatus includes a first storage part, a second storage part, an ejection part, a first supply path, a regulation part, and a second supply path. The second storage part is provided higher than the first storage part. The ejection part includes an ejection port. The first supply path is used for supplying ink from the first storage part to the second storage part and has a discharge port which is provided in the second storage part at a level higher than a predetermined specific position and lower than the ejection port. The regulation part regulates a backflow of ink in the first supply path. The second supply path is used for supplying ink from the second storage part to the ejection part and has a supply port which is provided in the second storage part at a level lower than the discharge port.

5 Claims, 4 Drawing Sheets

INKJET RECORDING APPARATUS CAPABLE OF PREVENTING BACKFLOW OF INK

INCORPORATION BY REFERENCE

This application is based upon and claims the benefit of priority from the corresponding Japanese Patent Application No. 2017-030782 filed on Feb. 22, 2017, the entire contents of which are incorporated herein by reference.

BACKGROUND

The present disclosure relates to an inkjet recording apparatus.

In an inkjet recording apparatus for forming an image by an inkjet system, a second storage part such as a sub ink tank may be provided on an ink supply path from a first storage part such as an ink container to an ejection part such as a recording head. For example, in this type of inkjet recording apparatus, the amount of ink supplied from the first storage part to the second storage part is controlled such that the surface of the ink stored in the second storage part is at a predetermined level lower than an ink ejection port of the ejection part. This allows the water pressure of the ink in the ejection part to be adjusted, so that leakage of the ink from the ink ejection port, and backflow of the ink from the ejection part to the second storage part, are prevented.

SUMMARY

An inkjet recording apparatus according to an aspect of the present disclosure includes a first storage part, a second storage part, an ejection part, a first supply path, a regulation part, and a second supply path. The first storage part stores ink. The second storage part is provided higher than the first storage part and stores the ink supplied from the first storage part. The ejection part includes an ejection port from which the ink supplied from the second storage part is ejected. The first supply path connects the first storage part and the second storage part, and has a discharge port which is provided in the second storage part at a level higher than a predetermined specific position and lower than the ejection port. The specific position is set at a lower-limit level of a surface of the ink in the second storage part so as to prevent a backflow of the ink from the ejection port to the second storage part. The regulation part regulates a flow of the ink from the second storage part to the first storage part in the first supply path. The second supply path connects the second storage part and the ejection part and has a supply port which is provided in the second storage part at a level lower than the discharge port.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

[Outlined Configuration of Inkjet Recording Apparatus 10]

Figure 1:
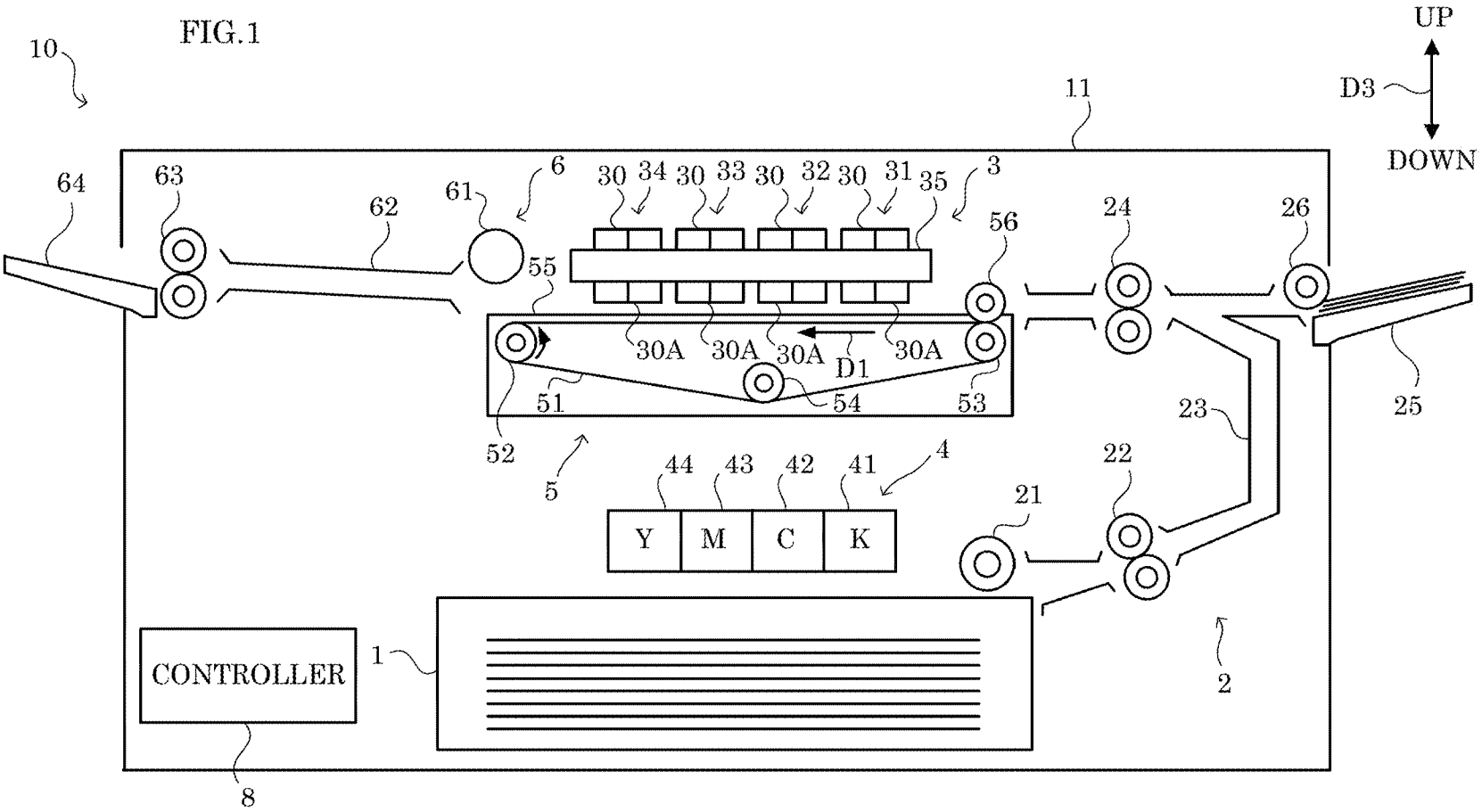
FIG. 1 is a diagram showing a configuration of an inkjet recording apparatus according to an embodiment of the present disclosure.
Figure 2:
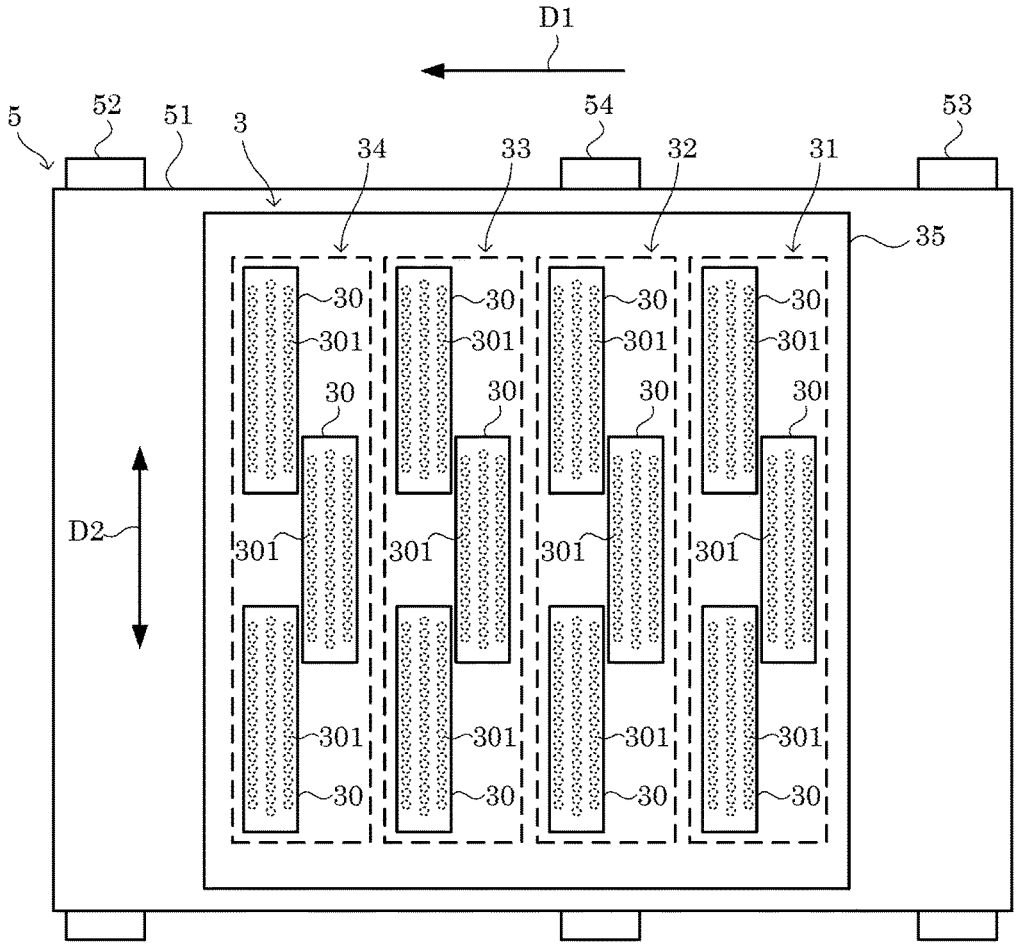
FIG. 2 is a diagram showing a configuration of a recording part of the inkjet recording apparatus according to the embodiment of the present disclosure.
Figure 3:
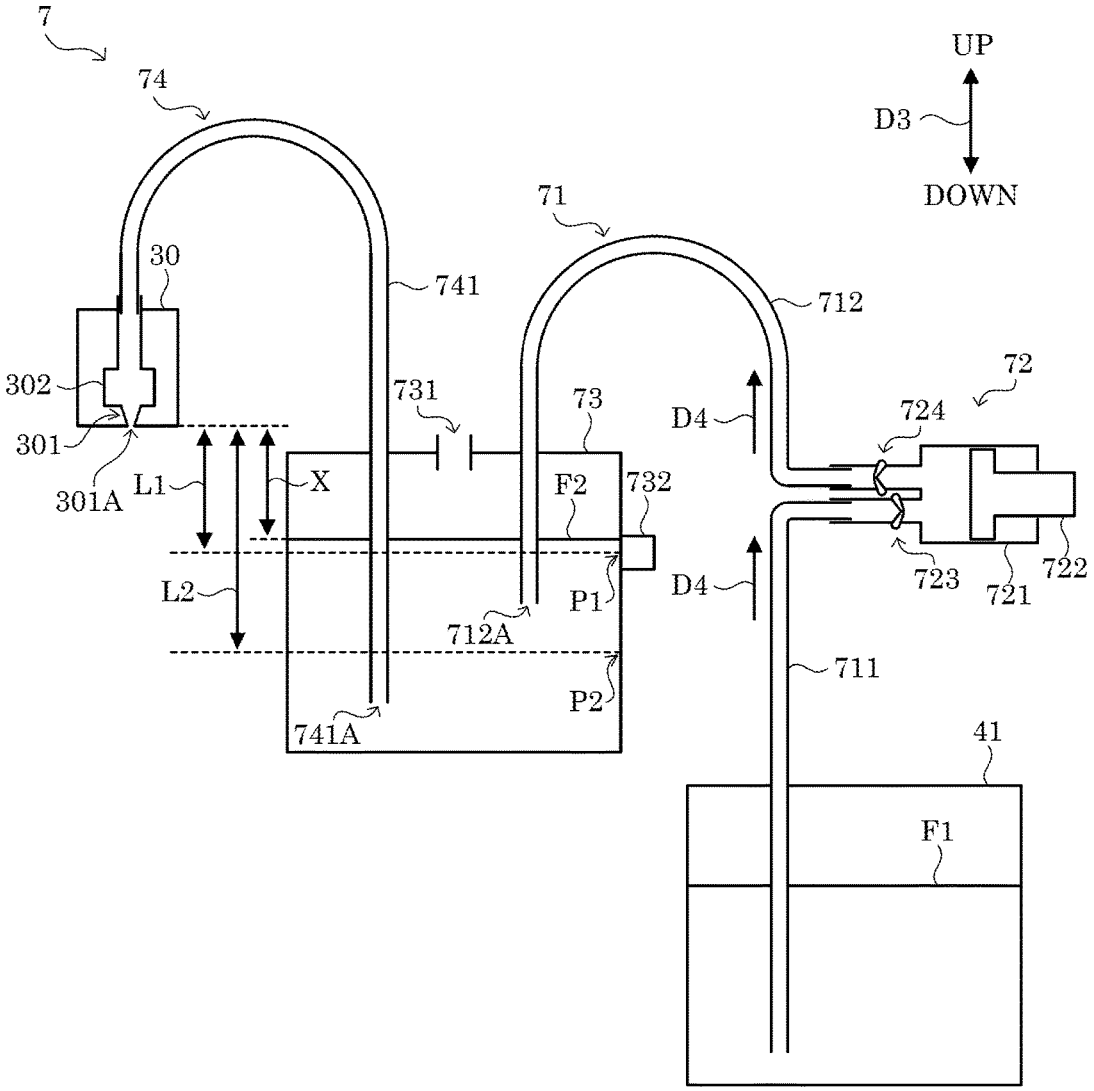
FIG. 3 is a diagram showing a configuration of an ink supply part of the inkjet recording apparatus according to the embodiment of the present disclosure.

First, a description is given of an outlined configuration of an inkjet recording apparatus 10 according to an embodiment of the present disclosure, with reference to FIG. 1 to FIG. 3. Here, FIG. 1 is a schematic cross-sectional view showing a configuration of the inkjet recording apparatus 10. FIG. 2 is a plan view showing a configuration of a recording part 3. FIG. 3 is a schematic view showing a configuration of an ink supply part 7. It is noted that for the sake of explanation, a vertical direction in a state where the inkjet recording apparatus 10 is installed in a usable manner (the state shown in FIG. 1) is defined as an up-down direction D3.

The inkjet recording apparatus 10 is a printer that can form an image by an inkjet system. It is noted that the present disclosure is applicable to inkjet recording apparatuses such as a facsimile apparatus, a copier, and a multifunction peripheral that can form an image by an inkjet system.

As shown in FIG. 1 and FIG. 3, the inkjet recording apparatus 10 includes a sheet feed cassette 1, a sheet feed part 2, a recording part 3, an ink container part 4, a conveyance unit 5, a sheet discharge part 6, ink supply parts 7, and a controller 8.

The sheet feed cassette 1 stores sheets that are print targets in the inkjet recording apparatus 10. For example, the sheets stored in the sheet feed cassette 1 are sheet-like materials such as sheets of paper, sheets of coated paper, postcards, envelopes, and OHP sheets.

The sheet feed part 2 supplies sheets stored in the sheet feed cassette 1 one by one to the recording part 3. As shown in FIG. 1, the sheet feed part 2 includes a pickup roller 21, a conveyance roller 22, a conveyance path 23, a registration roller 24, a manual feed tray 25, and a sheet feed roller 26. The pickup roller 21 picks up, one by one, the sheets stored in the sheet feed cassette 1. The conveyance roller 22 conveys the sheet picked up by the pickup roller 21 to the registration roller 24. The conveyance path 23 is a moving passage of the sheet from the sheet feed cassette 1 and the manual feed tray 25 to the recording part 3. The registration roller 24 conveys the sheet to the recording part 3 at a predetermined conveyance timing (image writing timing). The manual feed tray 25 and the sheet feed roller 26 are used to supply sheets from outside.

The recording part 3 records an image on a sheet supplied from the sheet feed part 2. As shown in FIG. 1, the recording part 3 includes line heads 31, 32, 33, and 34 and a head frame 35 supporting the line heads, wherein the line heads 31 to 34 respectively correspond to colors of black, cyan, magenta, and yellow. The head frame 35 is supported by a housing 11 of the inkjet recording apparatus 10. It is noted that the number of line heads mounted in the recording part is not limited to 4 (four), but may be 1 (one) or 2 (two) or more excluding 4.

The line heads 31 to 34 are so-called line-head-type recording heads. That is, the inkjet recording apparatus 10 is a so-called line-head-type inkjet recording apparatus. The line heads 31 to 34 are elongated in a width direction D2 perpendicular to a sheet conveyance direction D1 (see FIG. 2). Specifically, each of the line heads 31 to 34 has a length that corresponds to the width of a sheet of the maximum size among sheets that can be stored in the sheet feed cassette 1. The line heads 31 to 34 are fixed to the head frame 35 at regular intervals along the sheet conveyance direction D1.

As shown in FIG. 2, each of the line heads 31 to 34 includes a plurality of recording heads 30. The recording heads 30 eject ink toward a sheet conveyed by the conveyance unit 5. Specifically, a lot of nozzles 301 for ejecting ink are provided on a facing surface 30A of each of the recording heads 30 (see FIG. 1), each of the nozzles 301 having an ejection port 301A (see FIG. 3), the facing surface 30A facing the sheet conveyed by the conveyance unit 5. In addition, each of the recording heads 30 includes pressurizing chambers 302 (see FIG. 3), piezoelectric elements (not shown), and communication flow passages (not shown), the pressurizing chambers 302 respectively corresponding to the nozzles 301, the piezoelectric elements 302 respectively corresponding to the pressurizing chambers 302, the communication flow passages being respectively communicated with the pressurizing chambers 302. Upon application of a voltage, each of the piezoelectric elements causes ink to be ejected from the nozzle 301. Specifically, each of the piezoelectric elements pressurizes ink stored in the pressurizing chamber 302 so that the ink is ejected from the nozzle 301. Here, each of the recording heads 30 is an example of the ejection part of the present disclosure.

In the present embodiment, in the line head 31, three recording heads 30 are arranged in zigzag along the width direction D2. In addition, in each of the other line heads 32 to 34, as in the line head 31, three recording heads 30 are arranged in zigzag along the width direction D2. It is noted that FIG. 2 shows a state where the recording part 3 is viewed from the upper side of FIG. 1.

The ink container part 4 includes ink containers 41, 42, 43, and 44 that respectively store black, cyan, magenta, and yellow ink. The ink containers 41, 42, 43, and 44 are connected to the line heads 31 to 34 of the same color, via the ink supply parts 7, respectively. Here, each of the ink containers 41 to 44 is an example of the first storage part of the present disclosure.

The conveyance unit 5 is disposed below the line heads 31 to 34. The conveyance unit 5 conveys the sheet in such a state where the sheet faces the facing surfaces 30A of the recording heads 30. As shown in FIG. 1, the conveyance unit 5 includes a sheet conveyance belt 51 on which the sheet is placed, stretching rollers 52 to 54, and a conveyance frame 55, the sheet conveying belt 51 being stretched over the stretching rollers 52 to 54, the conveyance frame 55 supporting these members. It is noted that the interval between the sheet conveyance belt 51 and the facing surfaces 30A is adjusted so that during an image recording, the interval between the sheet and the facing surfaces 30A is, for example, 1 (one) mm.

The stretching roller 52 is coupled with a rotation shaft of a motor (not shown). When the motor is driven and the stretching roller 52 is rotated counterclockwise, the sheet conveyance belt 51 moves rotationally so as to convey the sheet in the conveyance direction D1. As the sheet conveyance belt 51 moves rotationally in such a manner, the sheet supplied from the sheet feed part 2 is conveyed through the recording part 3 toward the sheet discharge part 6. It is noted that the conveyance unit 5 also includes a suction unit (not shown) for sucking air through a lot of through holes formed in the sheet conveyance belt 51 so that the sheet is attracted by the sheet conveyance belt 51. In addition, a pressure roller 56 is provided positioned to face the stretching roller 53 so as to press the conveyed sheet against the sheet conveyance belt 51.

The sheet discharge part 6 is provided downstream of the recording part 3 in the conveyance direction D1. As shown in FIG. 1, the sheet discharge part 6 includes a drying device 61, a conveyance path 62, a sheet discharge roller 63, and a sheet discharge tray 64. The drying device 61 dries the ink that has been fixed to the sheet, by, for example, blowing air to the sheet. The sheet dried by the drying device 61 is fed to the conveyance path 62, and is discharged onto the sheet discharge tray 64 by the sheet discharge roller 63.

Figure 4:
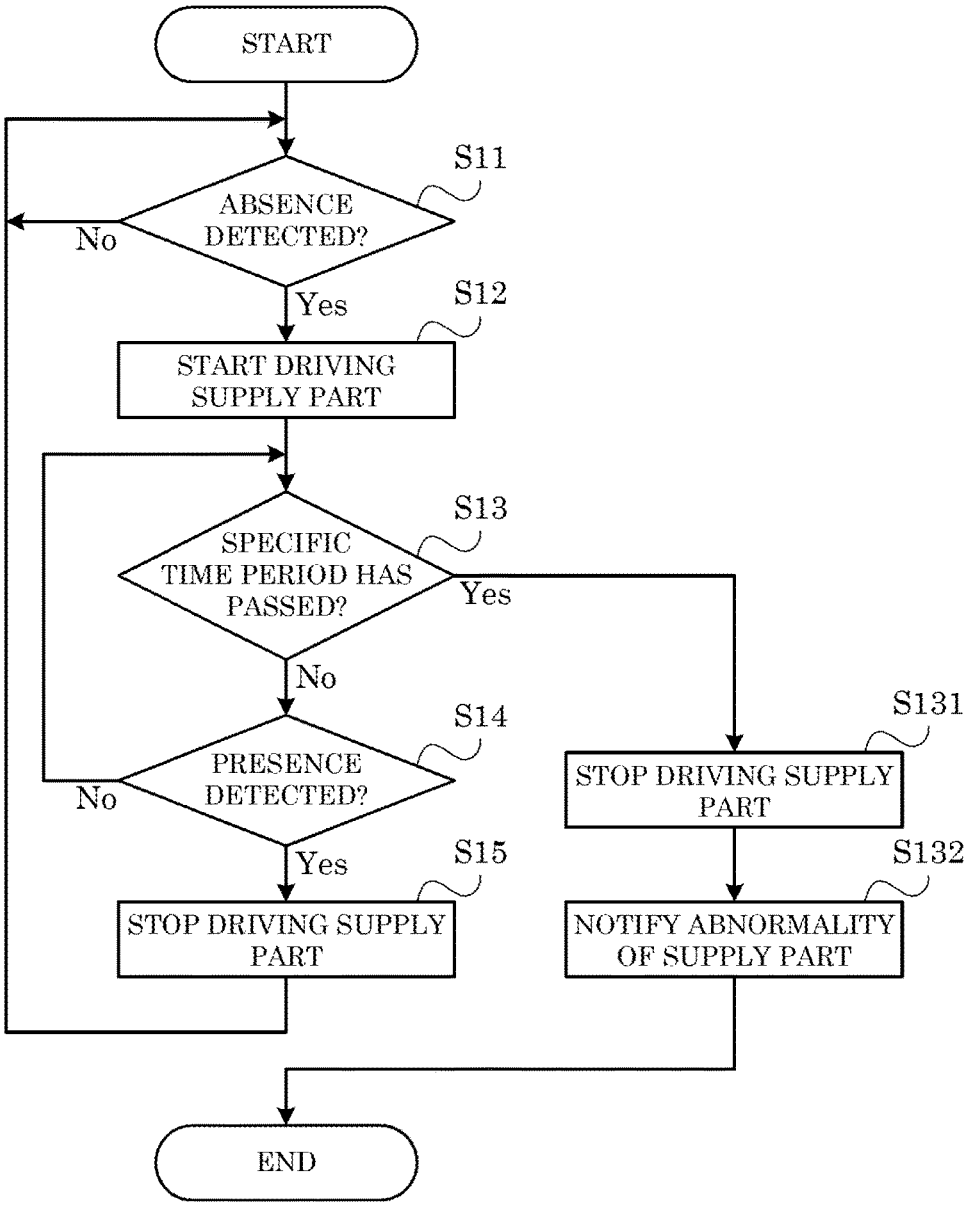
FIG. 4 is a flowchart showing an example of a supply control process executed in the inkjet recording apparatus according to the embodiment of the present disclosure.

The controller 8 includes control equipment such as CPU, ROM, and RAM that are not shown. The CPU is a processor that executes various calculation processes. The ROM is a nonvolatile storage device in which various information such as control programs for causing the CPU to execute various processes are stored in advance. A supply control program is stored in the ROM in advance, wherein the supply control program causes the CPU to execute a supply control process (see the flowchart of FIG. 4) that is described below. The RAM is a volatile storage device that is used as a temporary storage memory (working area) for the various processes executed by the CPU. In the controller 8, the CPU executes the various control programs stored in advance in the ROM. This allows the inkjet recording apparatus 10 to be controlled comprehensively by the controller 8.

The ink supply parts 7 supply the ink stored in the ink container part 4 respectively to the line heads 31 to 34 of the recording part 3. As shown in FIG. 3, each of the ink supply parts 7 includes a first supply path 71, a supply part 72, a sub ink tank 73, and a second supply path 74. The ink supply parts 7 are provided respectively in correspondence with the ink containers 41 to 44. It is noted that FIG. 3 shows an ink supply part 7 that corresponds to the ink container 41.

The first supply path 71 is an ink moving passage connecting the ink container 41 and the sub ink tank 73. As shown in FIG. 3, the first supply path 71 includes a first tube 711 and a second tube 712. The first tube 711 connects the ink container 41 and the supply part 72. The second tube 712 connects the supply part 72 and the sub ink tank 73. For example, the first tube 711 and the second tube 712 are made of resin.

The supply part 72 is configured to supply the ink from the ink container 41 to the sub ink tank 73 via the first supply path 71. For example, as shown in FIG. 3, the supply part 72 includes a cylinder 721, a piston 722, a first regulation part 723, and a second regulation part 724. The first regulation part 723 is configured to regulate the flow of ink from the cylinder 721 to the ink container 41 in the first tube 711. The second regulation part 724 is configured to regulate the flow of ink from the sub ink tank 73 to the cylinder 721 in the second tube 712. For example, the first regulation part 723 and the second regulation part 724 are backflow prevention valves that are configured to regulate the flow of the ink so that the ink flows in a supply direction D4 (see FIG. 3) from the ink container 41 to the sub ink tank 73. In the supply part 72, the piston 722 is reciprocally moved in the cylinder 721 so that the ink is drawn up from the ink container 41 into the cylinder 721, and is supplied to the sub ink tank 73. It is noted that the supply part 72 may be configured to apply a propulsive force to the ink by a rotation of a rotating member. In addition, the first regulation part 723 and the second regulation part 724 may be electromagnetic valves whose opening and closing operations are controlled by the controller 8. Furthermore, the first regulation part 723 and the second regulation part 724 may be provided independently of the supply part 72. Here, the first regulation part 723 and the second regulation part 724 are an example of the regulation part of the present disclosure.

The sub ink tank 73 stores ink which is supplied thereto from the ink container 41 by the supply part 72. The ink stored in the sub ink tank 73 is supplied to the corresponding recording head 30. As shown in FIG. 3, the sub ink tank 73 is positioned higher than the ink container 41 in the up-down direction D3. In this case, a force for causing the ink to flow in the reverse direction to the supply direction D4 acts on the ink in the first supply path 71 due to a difference of elevation between a surface F1 of the ink stored in the ink container 41 (see FIG. 3) and a surface F2 of the ink stored in the sub ink tank 73 (see FIG. 3). However, since the first regulation part 723 and the second regulation part 724 regulate the flow of the ink so that the ink in the first supply path 71 flows in the supply direction D4, the backflow of the ink from the sub ink tank 73 to the ink container 41 is prevented. Here, the sub ink tank 73 is an example of the second storage part of the present disclosure.

As shown in FIG. 3, the sub ink tank 73 includes a ventilation path 731 and a detection part 732. The ventilation path 731 allows a space above the surface F2 of the ink stored in the sub ink tank 73 to communicate with the outside of the sub ink tank 73. For example, as shown in FIG. 3, the ventilation path 731 is formed at an upper part of the sub ink tank 73. By forming the ventilation path 731, air pressure in the space above the ink surface F2 is maintained constant (at atmospheric pressure) regardless of the change in the amount of ink stored in the sub ink tank 73. The detection part 732 detects presence or absence of ink at a predetermined detection position P1 (see FIG. 3) in the sub ink tank 73. For example, the detection part 732 is a level sensor capable of detecting the ink surface F2. The detection part 732 outputs, to the controller 8 an electric signal whose value varies depending on presence or absence of the ink at the detection position P1.

The second supply path 74 is an ink moving passage connecting the sub ink tank 73 and the recording head 30. As shown in FIG. 3, the second supply path 74 includes a third tube 741. The third tube 741 connects the sub ink tank 73 and the recording head 30. For example, the third tube 741 is made of resin.

In the inkjet recording apparatus 10, as shown in FIG. 3, the ejection port 301A of the recording head 30 is positioned higher than the detection position P1 in the up-down direction D3. In addition, in the inkjet recording apparatus 10, a predetermined distance L1 is provided between the ejection port 301A and the detection position P1 in the up-down direction D3. Here, the distance L1 is set so that the water pressure (negative pressure) of the ink in the recording head 30 prevents leakage of the ink from the ejection port 301A and backflow of the ink from the recording head 30 to the sub ink tank 73. For example, the distance L1 is set based on the surface tension of the ink at the ejection port 301A, the capillary phenomenon that occurs in the inside of the recording head 30, and the channel resistance in the second supply path 74 and the recording head 30.

In addition, in the inkjet recording apparatus 10, the amount of ink supplied from the ink container 41 to the sub ink tank 73 is controlled so that the surface F2 of the ink in the sub ink tank 73 is not separated from the detection position P1 by more than a predetermined specific distance in the up-down direction D3.

Specifically, when the detection part 732 detects absence of the ink at the detection position P1, the controller 8 drives the supply part 72. For example, the controller 8 drives the supply part 72 for a predetermined specific time period that corresponds to the specific distance.

With the above-described arrangement, the level of the surface F2 of the ink in the sub ink tank 73 is maintained to be within a range between a lower-limit level and an upper-limit level, wherein the lower-limit level is located below the detection position P1 by the specific distance, and the upper-limit level is located above the detection position P1 by the specific distance. As a result, a difference between the distance L1 and a distance X (see FIG. 3) does not become larger than the specific distance, wherein the distance X is a distance between the ejection port 301A and the surface F2 of the ink in the sub ink tank 73 in the up-down direction D3. Accordingly, regardless of how much the ink is consumed by the printing, the water pressure of the ink in the recording head 30 is adjusted to a water pressure that can prevent the leakage of the ink from the ejection port 301A, and the backflow of the ink from the recording head 30 to the sub ink tank 73. In addition, with the configuration where the water pressure of the ink in the recording head 30 is adjusted to be within a predetermined range of negative pressures, when the ink is ejected from the nozzle 301, the same amount of ink as the amount of ejected ink is supplied from the sub ink tank 73 to the recording head 30.

Meanwhile, conventionally, in a case where the sub ink tank 73 is disposed higher than the ink container 41, the first regulation part 723 and the second regulation part 724 may break down, and the ink may flow back from the sub ink tank 73 to the ink container 41. In that case, the surface F2 of the ink in the sub ink tank 73 may fall, the distance X between the ink surface F2 and the ejection port 301A may become large, and the ink may flow back from the recording head 30 to the sub ink tank 73.

On the other hand, in the inkjet recording apparatus 10 according to the embodiment of the present disclosure, as described below, it is possible to prevent a backflow of the ink from the recording head 30 to the sub ink tank 73.

Specifically, in the inkjet recording apparatus 10, an end part 712A and an end part 741A are disposed in the sub ink tank 73 so as to satisfy a predetermined positional relationship, wherein the end part 712A is an end part of the second tube 712 from which the ink supplied from the ink container 41 is discharged, and the end part 741A is an end part of the third tube 741 from which the ink is drawn up so as to be supplied to the recording head 30. Here, the end part 712A of the second tube 712 is an example of the discharge port of the present disclosure. In addition, the end part 741A of the third tube 741 is an example of the supply port of the present disclosure.

More specifically, in the inkjet recording apparatus 10, a distance L2 (see FIG. 3) is acquired in advance, wherein the distance L2 is a maximum value of the distance X that can prevent a backflow of the ink from the recording head 30 to the sub ink tank 73. In other words, in the inkjet recording apparatus 10, when the distance X exceeds the distance L2, a backflow of the ink from the recording head 30 to the sub ink tank 73 is started. It is noted that the distance L2 may be calculated based on the surface tension of the ink at the ejection port 301A, the capillary phenomenon that occurs in the inside of the recording head 30, and the channel resistance in the second supply path 74 and the recording head 30, or may be measured by using the inkjet recording apparatus 10.

In addition, in the inkjet recording apparatus 10, the end part 712A of the second tube 712 is provided in the sub ink tank 73 at a level that is higher than a specific position P2 (see FIG. 3) that is located below the ejection port 301A by the distance L2 in the up-down direction D3. As a result, in the inkjet recording apparatus 10, even if the ink flows back from the sub ink tank 73 to the ink container 41, the fall of the ink surface F2 is restricted to the level of the end part 712A of the second tube 712, and the ink surface F2 does not fall to the specific position P2. With this configuration, it is possible to prevent the ink from flowing back from the recording head 30 to the sub ink tank 73 due to a fall of the ink surface F2 to a level lower than the specific position P2.

In addition, in the inkjet recording apparatus 10, the end part 741A of the third tube 741 is provided in the sub ink tank 73 at a level lower than the end part 712A of the second tube 712. As a result, in the inkjet recording apparatus 10, even if the ink flows back from the sub ink tank 73 to the ink container 41, it does not happen that the ink surface F2 falls to a level of the end part 741A of the third tube 741. This prevents that the end part 741A of the third tube 741 is positioned above the ink surface F2 and the ink flows back from the recording head 30 to the sub ink tank 73.

Here, in the inkjet recording apparatus 10, as shown in FIG. 3, the detection position P1 is set to a level higher than the specific position P2 and the end part 712A of the second tube 712. That is, the end part 712A of the second tube 712 is provided lower than the detection position P1. With this configuration, compared to a configuration where the end part 712A of the second tube 712 is provided higher than the detection position P1, it does not happen that the ink surface F2 waves due to an impact that is generated when the ink discharged from the end part 712A drops on the ink surface F2, resulting in a decrease in the detection accuracy of the detection part 732. It is noted that the end part 712A of the second tube 712 may be provided higher than the detection position P1. For example, the end part 712A of the second tube 712 may be connected to an opening in the upper surface of an ink storage part of the sub ink tank 73.

In addition, the controller 8 notifies an abnormality of the supply part 72 when the detection part 732 does not detect presence of the ink at the detection position P1 even after the specific time period has passed since the driving start of the supply part 72. For example, the controller 8 displays, on an operation/display part (not shown), a message that the supply part 72 is abnormal. This allows the user to take an action to deal with the abnormality, such as requesting a maintenance. It is noted that in a case where the first regulation part 723 and the second regulation part 724 are provided independently of the supply part 72, the controller 8 may notify that either the supply part 72 or a set of the first regulation part 723 and the second regulation part 724 is abnormal, or notify that both of them are abnormal.

[Supply Control Process]

In the following, steps S11, S12, . . . represent numbers assigned to the processing procedures (steps) executed by the controller 8. It is noted that the controller 8 executes the supply control process when the inkjet recording apparatus 10 is powered on, or when the inkjet recording apparatus 10 returns to a normal operation state from a sleep state where some functions of the inkjet recording apparatus 10 stop. In addition, the controller 8 executes the supply control process for each of the ink supply parts 7. In the following description, it is supposed that the supply control process is executed with respect to the ink supply part 7 that corresponds to the ink container 41.

<Step S11>

First, in step S11, the controller 8 determines whether or not the detection part 732 has detected absence of ink at the detection position P1.

Here, upon determining that absence of ink at the detection position P1 has been detected (Yes side at S11), the controller 8 moves the process to step S12. In addition, upon determining that absence of ink at the detection position P1 has not been detected (No side at S11), the controller 8 waits, at step S11, detection of absence of ink at the detection position P1.

<Step S12>

In step S12, the controller 8 starts driving the supply part 72.

<Step S13>

In step S13, the controller 8 determines whether or not the specific time period has passed since the driving start of the supply part 72 in step S12.

Here, upon determining that the specific time period has passed since the driving start of the supply part 72 (Yes side at S13), the controller 8 moves the process to step S131. In addition, upon determining that the specific time period has not passed since the driving start of the supply part 72 (No side at S13), the controller 8 moves the process to step S14.

<Step S14>

In step S14, the controller 8 determines whether or not the detection part 732 has detected presence of ink at the detection position P1.

Here, upon determining that presence of ink at the detection position P1 has been detected (Yes side at S14), the controller 8 moves the process to step S15. In addition, upon determining that presence of ink at the detection position P1 has not been detected (No side at S14), the controller 8 moves the process to step S13, and waits detection of the presence of ink at the detection position P1 until the specific time period passes.

<Step S15>

In step S15, the controller 8 stops driving the supply part 72. Subsequently, the controller 8 moves the process to step S11, and executes the processes of steps S12 to S15 each time the detection part 732 detects absence of ink at the detection position P1.

<Step S131>

On the other hand, when it is determined in step S13 that the specific time period has passed since the driving start of the supply part 72, the controller 8 executes the process of step S131. In step S131, the controller 8 stops driving the supply part 72.

<Step S132>

In step S132, the controller 8 notifies an abnormality of the supply part 72. For example, the controller 8 displays, on the operation/display part, a message that the supply part 72 is abnormal. It is noted that in the supply control process, the process of step S132 may be omitted.

As described above, in the inkjet recording apparatus 10, the end part 712A of the second tube 712 is provided higher than the specific position P2. In addition, the end part 741A of the third tube 741 is provided lower than the end part 712A of the second tube 712. With this configuration, it is possible to prevent the ink from flowing back from the recording head 30 to the sub ink tank 73 even when the first regulation part 723 and the second regulation part 724 break down.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

a first storage part storing ink;

a second storage part provided higher than the first storage part and storing the ink supplied from the first storage part;

an ejection part including an ejection port from which the ink supplied from the second storage part is ejected;

a first supply path connecting the first storage part and the second storage part and having a discharge port, the discharge port being provided in the second storage part at a level higher than a predetermined specific position and lower than the ejection port, the specific position being set at a lower-limit level of a surface of the ink in the second storage part so as to prevent a backflow of the ink from the ejection port to the second storage part;

a regulation part configured to regulate a flow of the ink from the second storage part to the first storage part in the first supply path; and a second supply path connecting the second storage part and the ejection part and having a supply port, the supply port being provided in the second storage part at a level lower than the discharge port.

2. The inkjet recording apparatus according to claim 1, wherein the second storage part includes a ventilation path configured to allow a space above the surface of the ink in the second storage part to communicate with outside of the second storage part.

3. The inkjet recording apparatus according to claim 1, further comprising:

a supply part configured to supply the ink from the first storage part to the second storage part via the first supply path;

a detection part configured to detect presence or absence of the ink at a detection position higher than the specific position in the second storage part; and a controller configured to drive the supply part when the detection part detects absence of the ink at the detection position.

4. The inkjet recording apparatus according to claim 3, wherein the detection position is higher than the discharge port.

5. The inkjet recording apparatus according to claim 3, wherein the controller notifies an abnormality of either or both of the regulation part and the supply part when the detection part does not detect presence of the ink at the detection position even after a predetermined specific time period has passed since a driving start of the supply part.

* * * * *